US007559379B2

(12) United States Patent
Hall et al.

(10) Patent No.: US 7,559,379 B2
(45) Date of Patent: Jul. 14, 2009

(54) DOWNHOLE STEERING

(76) Inventors: David R. Hall, 2185 S. Larsen Pkwy., Provo, UT (US) 84606; David Lundgreen, 2185 S. Larsen Pkwy., Provo, UT (US) 84606; Daryl Wise, 2185 S. Larsen Pkwy., Provo, UT (US) 84606

( * ) Notice: Subject to any disclaimer, the term of this patent is extended or adjusted under 35 U.S.C. 154(b) by 113 days.

(21) Appl. No.: 11/837,321

(22) Filed: Aug. 10, 2007

(65) Prior Publication Data

US 2007/0272443 A1 Nov. 29, 2007

Related U.S. Application Data

(63) Continuation-in-part of application No. 11/750,700, filed on May 18, 2007, which is a continuation-in-part of application No. 11/737,034, filed on Apr. 18, 2007, now Pat. No. 7,503,405, which is a continuation-in-part of application No. 11/686,638, filed on Mar. 15, 2007, now Pat. No. 7,424,922, which is a continuation-in-part of application No. 11/680,997, filed on Mar. 1, 2007, now Pat. No. 7,419,016, which is a continuation-in-part of application No. 11/673,872, filed on Feb. 12, 2007, now Pat. No. 7,484,576, which is a continuation-in-part of application No. 11/611,310, filed on Dec. 15, 2006, application No. 11/837,321, and a continuation-in-part of application No. 11/278,935, filed on Apr. 6, 2006, now Pat. No. 7,426,968, which is a continuation-in-part of application No. 11/277,394, filed on Mar. 24, 2006, now Pat. No. 7,398,837, which is a continuation-in-part of application No. 11/277,380, filed on Mar. 24, 2006, which is a continuation-in-part of application No. 11/306,976, filed on Jan. 18, 2006, which is a continuation-in-part of application No. 11/306,307, filed on Dec. 22, 2005, which is a continuation-in-part of application No. 11/306,022, filed on Dec. 14, 2005, which is a continuation-in-part of application No. 11/164,391, filed on Nov. 21, 2005.

(51) Int. Cl.
*E21B 7/06* (2006.01)

(52) U.S. Cl. ..... 175/61; 175/73; 175/398

(58) Field of Classification Search ..... 175/61, 175/73, 398, 385
See application file for complete search history.

(56) References Cited

U.S. PATENT DOCUMENTS

| | | | | |
|---|---|---|---|---|
| 465,103 | A | 12/1891 | Wegner | |
| 616,118 | A | 12/1898 | Kunhe | |
| 923,513 | A * | 6/1909 | Hardsocg | 175/389 |
| 946,060 | A | 1/1910 | Looker | |
| 1,116,154 | A | 11/1914 | Stowers | |
| 1,183,630 | A | 5/1916 | Bryson | |

(Continued)

*Primary Examiner*—Hoang Dang
(74) *Attorney, Agent, or Firm*—Tyson J. Wilde

(57) ABSTRACT

In one aspect of the present invention, a drill string has a drill bit with a body intermediate a shank and a working face. The working face has at least one cutting element. A jack element is disposed within the drill bit body and has a distal end substantially protruding from the working face. The distal end has a primary deflecting surface having an angle relative to a central axis of the jack element of 15 to 75 degrees.

19 Claims, 8 Drawing Sheets

U.S. PATENT DOCUMENTS 1,189,560 A 7/1916 Gondos
1,360,908 A 11/1920 Everson
1,387,733 A 8/1921 Midgett
1,460,671 A 7/1923 Hebsacker
1,544,757 A 7/1925 Hufford
1,821,474 A 9/1931 Mercer
1,879,177 A 9/1932 Gault
2,054,255 A 9/1936 Howard
2,064,255 A 12/1936 Garfield
2,169,223 A 8/1939 Christian
2,196,940 A * 4/1940 Potts ..... 175/400
2,218,130 A 10/1940 Court
2,300,016 A * 10/1942 Scott et al. ..... 175/75
2,320,136 A 5/1943 Kammerer
2,466,991 A 4/1949 Kammerer
2,540,464 A 2/1951 Stokes
2,544,036 A 3/1951 Kammerer
2,755,071 A 7/1956 Kammerer
2,776,819 A 1/1957 Brown
2,819,043 A 1/1958 Henderson
2,838,284 A 6/1958 Austin
2,894,722 A 7/1959 Buttolph
2,901,223 A 8/1959 Scott
2,963,102 A 12/1960 Smith
3,135,341 A 6/1964 Ritter
3,294,186 A 12/1966 Buell
3,301,339 A 1/1967 Pennebaker
3,379,264 A 4/1968 Cox
3,429,390 A 2/1969 Bennett
3,493,165 A 2/1970 Schonfield
3,583,504 A 6/1971 Aalund
3,764,493 A 10/1973 Rosar
3,821,993 A 7/1974 Kniff
3,955,635 A 5/1976 Skidmore
3,960,223 A 6/1976 Kleine
4,081,042 A 3/1978 Johnson
4,096,917 A 6/1978 Harris
4,106,577 A 8/1978 Summer
4,176,723 A 12/1979 Arceneaux
4,253,533 A 3/1981 Baker
4,280,573 A 7/1981 Sudnishnikov
4,304,312 A 12/1981 Larsson
4,307,786 A 12/1981 Evans
4,397,361 A 8/1983 Langford
4,416,339 A 11/1983 Baker
4,445,580 A 5/1984 Sahley
4,448,269 A 5/1984 Ishikawa
4,499,795 A 2/1985 Radtke
4,531,592 A 7/1985 Hayatdavoudi
4,535,853 A 8/1985 Ippolito
4,538,691 A 9/1985 Dennis
4,566,545 A 1/1986 Story
4,574,895 A * 3/1986 Dolezal et al. ..... 175/429
4,640,374 A 2/1987 Dennis
4,852,672 A 8/1989 Behrens
4,889,017 A 12/1989 Fuller
4,962,822 A 10/1990 Pascale
4,981,184 A 1/1991 Knowlton
5,009,273 A 4/1991 Grabinski
5,027,914 A 7/1991 Wilson
5,038,873 A 8/1991 Jurgens
5,119,892 A 6/1992 Clegg
5,141,063 A 8/1992 Quesenbury
5,186,268 A 2/1993 Clegg
5,222,566 A 6/1993 Taylor
5,255,749 A 10/1993 Bumpurs
5,265,682 A 11/1993 Russell
5,361,859 A 11/1994 Tibbitts
5,410,303 A 4/1995 Comeau
5,417,292 A 5/1995 Polakoff
5,423,389 A 6/1995 Warren
5,507,357 A 4/1996 Hult
5,560,440 A 10/1996 Tibbitts
5,568,838 A 10/1996 Struthers
5,655,614 A 8/1997 Azar
5,678,644 A 10/1997 Fielder
5,732,784 A 3/1998 Nelson
5,794,728 A 8/1998 Palmberg
5,896,938 A 4/1999 Moeny
5,947,215 A 9/1999 Lundell
5,950,743 A 9/1999 Cox
5,957,223 A 9/1999 Doster
5,957,225 A 9/1999 Sinor
5,967,247 A 10/1999 Pessier
5,979,571 A 11/1999 Scott et al.
5,992,547 A 11/1999 Caraway
5,992,548 A 11/1999 Silva
6,021,859 A 2/2000 Tibbitts
6,039,131 A 3/2000 Beaton
6,131,675 A 10/2000 Anderson
6,150,822 A 11/2000 Hong
6,186,251 B1 2/2001 Butcher
6,202,761 B1 3/2001 Forney
6,213,226 B1 4/2001 Eppink
6,223,824 B1 5/2001 Moyes
6,269,893 B1 8/2001 Beaton
6,296,069 B1 10/2001 Lamine
6,340,064 B2 1/2002 Fielder
6,364,034 B1 4/2002 Schoeffler
6,394,200 B1 5/2002 Watson
6,439,326 B1 8/2002 Huang et al.
6,474,425 B1 11/2002 Truax
6,484,825 B2 11/2002 Watson
6,510,906 B1 1/2003 Richert
6,513,606 B1 2/2003 Krueger
6,533,050 B2 3/2003 Molloy
6,594,881 B2 7/2003 Tibbitts
6,601,454 B1 8/2003 Botnan
6,622,803 B2 9/2003 Harvey
6,668,949 B1 12/2003 Rives
6,729,420 B2 5/2004 Mensa-Wilmot
6,732,817 B2 5/2004 Dewey
6,822,579 B2 11/2004 Goswani
6,929,076 B2 8/2005 Fanuel et al.
6,953,096 B2 10/2005 Glenhill
2003/0213621 A1 11/2003 Britten
2004/0238221 A1 12/2004 Runia
2004/0256155 A1 12/2004 Kriesels

* cited by examiner

DOWNHOLE STEERING

CROSS REFERENCE TO RELATED APPLICATIONS

This Patent Application is a continuation-in-part of U.S. patent application Ser. No. 11/750,700 filed on May 18, 2007. U.S. patent application Ser. No. 11/750,700 is a continuation-in-part of U.S. patent application Ser. No. 11/737,034 filed on Apr. 18, 2007 now U.S. Pat. No. 7,503,405 and entitled Rotary Valve for Steering a Drill Bit. U.S. patent application Ser. No. 11/737,034 is a continuation in-part of U.S. patent application Ser. No. 11/686,638 filed on Mar. 15, 2007 now U.S. Pat. No. 7,424,922 and entitled Rotary Valve for a Jack Hammer. U.S. patent application Ser. No. 11/686,638 is a continuation-in-part of U.S. patent application Ser. No. 11/680,997 filed on Mar. 1, 2007 now U.S. Pat. No. 7,419,016 and entitled Bi-center Drill Bit. U.S. patent application Ser. No. 11/680,997 is a continuation in-part of U.S. patent application Ser. No. 11/673,872 filed on Feb. 12, 2007 now U.S. Pat. No. 7,484,576 and entitled Jack Element in Communication with an Electric Motor and/or generator. U.S. patent application Ser. No. 11/673,872 is a continuation in-part of U.S. patent application Ser. No. 11/611,310 filed on Dec. 15, 2006 and which is entitled System for Steering a Drill String. This patent application is also a continuation in-part of U.S. patent application Ser. No. 11/278,935 filed on Apr. 6, 2006 now U.S. Pat. No. 7,426,968 and which is entitled Drill Bit Assembly with a Probe. U.S. patent application Ser. No. 11/278,935 is a continuation in-part of U.S. patent application Ser. No. 11/277,394 which filed on Mar. 24, 2006 now U.S. Pat. No. 7,398,837 and entitled Drill Bit Assembly with a Logging Device. U.S. patent application Ser. No. 11/277,394 is a continuation in-part of U.S. patent application Ser. No. 11/277,380 also filed on Mar. 24, 2006 and entitled A Drill Bit Assembly Adapted to Provide Power Downhole. U.S. patent application Ser. No. 11/277,380 is a continuation in-part of U.S. patent application Ser. No. 11/306,976 which was filed on Jan. 18, 2006 and entitled "Drill Bit Assembly for Directional Drilling." U.S. patent application Ser. No. 11/306,976 is a continuation in-part of Ser. No. 11/306,307 filed on Dec. 22, 2005, entitled Drill Bit Assembly with an Indenting Member. U.S. patent application Ser. No. 11/306,307 is a continuation in-part of U.S. patent application Ser. No. 11/306,022 filed on Dec. 14, 2005, entitled Hydraulic Drill Bit Assembly. U.S. patent application Ser. No. 11/306,022 is a continuation in-part of U.S. patent application Ser. No. 11/164,391 filed on Nov. 21, 2005, which is entitled Drill Bit Assembly. Aft of these applications are herein incorporated by reference in their entirety.

BACKGROUND OF THE INVENTION

This invention relates to steering systems, specifically steering systems for use in oil, gas, geothermal, and/or horizontal drilling. The ability to accurately adjust the direction of drilling in downhole applications is desirable to direct the borehole toward specific targets. A number of steering systems have been devised for this purpose.

One such system is disclosed in U.S. Pat. No. 2,498,192 to Wright, which is herein incorporated by reference for all that it contains. Wright discloses an apparatus for drilling well bores at a desired angle and in a predetermined direction, whereby the apparatus is particularly useful in directional drilling, side-tracking and similar operations.

U.S. Pat. No. 6,749,031 to Klemm, which is herein incorporated by reference for all that it contains, discloses a drilling system having a drilling head fixed to a drill string which comprises an outer pipe and a percussion string inserted therein, wherein the percussion string comprises a plurality of rods which bear against each other with their end faces. One object of the present invention is to provide a drilling system with an inner percussion string, which permits a greater variation in the drilling direction and which can be used as a directional drilling system. To attain that object the outer pipe is adapted to be deformable along its longitudinal axis and the end faces which bear against each other of two rods are so designed that they bear against each other substantially in surface contact upon inclined positioning of the axes of the two rods relative to each other.

U.S. Pat. No. 7,013,994 to Eddison, which is herein incorporated by reference for all that it contains, discloses a directional drilling apparatus for use in drilling a deviated bore comprising a mandrel for mounting to a drill string and having a main axis. A nonrotating mass is rotatably mounted on the mandrel and has a center-of-gravity spaced from the mandrel axis. The apparatus further comprises an offsetting arrangement including a nonrotating offsetting portion rotatably mounted on the mandrel, coupled to the mass, and having an outer profile defining an offset relative to the mandrel axis, and a bearing portion rotatably mounted on the offsetting portion. In use, the apparatus is run into an inclined bore on a string, and the offsetting portion is oriented relative to the mass. When the string is rotated the mass tends towards an orientation with its center-of-gravity positioned towards the low side of the bore and thus tends to maintain the offsetting portion in a desired relative orientation in the bore, the bearing portion rotationally isolating the offsetting portion from the bore wall.

BRIEF SUMMARY OF THE INVENTION

In one aspect of the present invention, a drill string has a drill bit with a body intermediate a shank and a working face. The working face has at least one cutting element. A jack element is disposed within the drill bit body and has a distal end substantially protruding from the working face. The distal end has a primary deflecting surface having an angle relative to a central axis of the jack element of 15 to 75 degrees.

More specifically, the primary deflecting surface may have an angle relative to the central axis of 40 to 50 degrees. The primary deflecting surface may have a surface area of 0.5 to 4 square inches. A tip of the distal end to the central axis of the jack element may comprise a distance of 0.10 to 0.20 inches. The primary deflecting surface and a secondary deflecting surface of the distal end may form a 90 degree angle. The primary surface may also have a radius of curvature of 0.75 to 1.25 inches, whereas the secondary surface may have a radius of curvature of 0.25 to 0.75 inch. The primary surface may comprise a substantially flat portion. Also, the primary surface may have a circular, rectangular, elliptical, or triangular geometry.

The jack element may have a length of 6 to 20 inches and may have a diameter of 0.50 to 1.00 inch. The jack element may also be supported by a bushing and/or a bearing and may be in communication with at least one bearing. The jack element may be rotationally isolated from the drill string. The drill string and the jack element may rotate opposite each other. The jack element may be adapted for attachment to a motor, such as an electric motor or a hydraulic motor. The distal end of the jack element may have rounded edges. An end of the jack element opposite the distal end may have a diameter larger than a diameter of the jack element proximal the distal end.

In another aspect of the present invention, a method has steps for steering the drill string. The jack element disposed within the drill bit body has a biased distal end substantially protruding from the working face. The drill bit is deployed into a borehole when connected to a drill string. The distal end of the jack element engages the formation. The jack element steers the drill string along a desired trajectory.

The desired trajectory may have a substantially straight portion. The biased distal end may have a primary deflecting surface. The drill bit may comprise a build rate of 6 to 20 degrees per 100 feet drilled. The jack element may be rotationally isolated from the drill string. A sensor disposed on the surface of the drill string may be adapted to receive acoustic signals produced by the drill bit. In some embodiments, a sensor may be located along the tool string such as in the bottom hole assembly and/or elsewhere along the tool string.

DETAILED DESCRIPTION OF THE INVENTION AND THE PREFERRED EMBODIMENT

Figure 1:
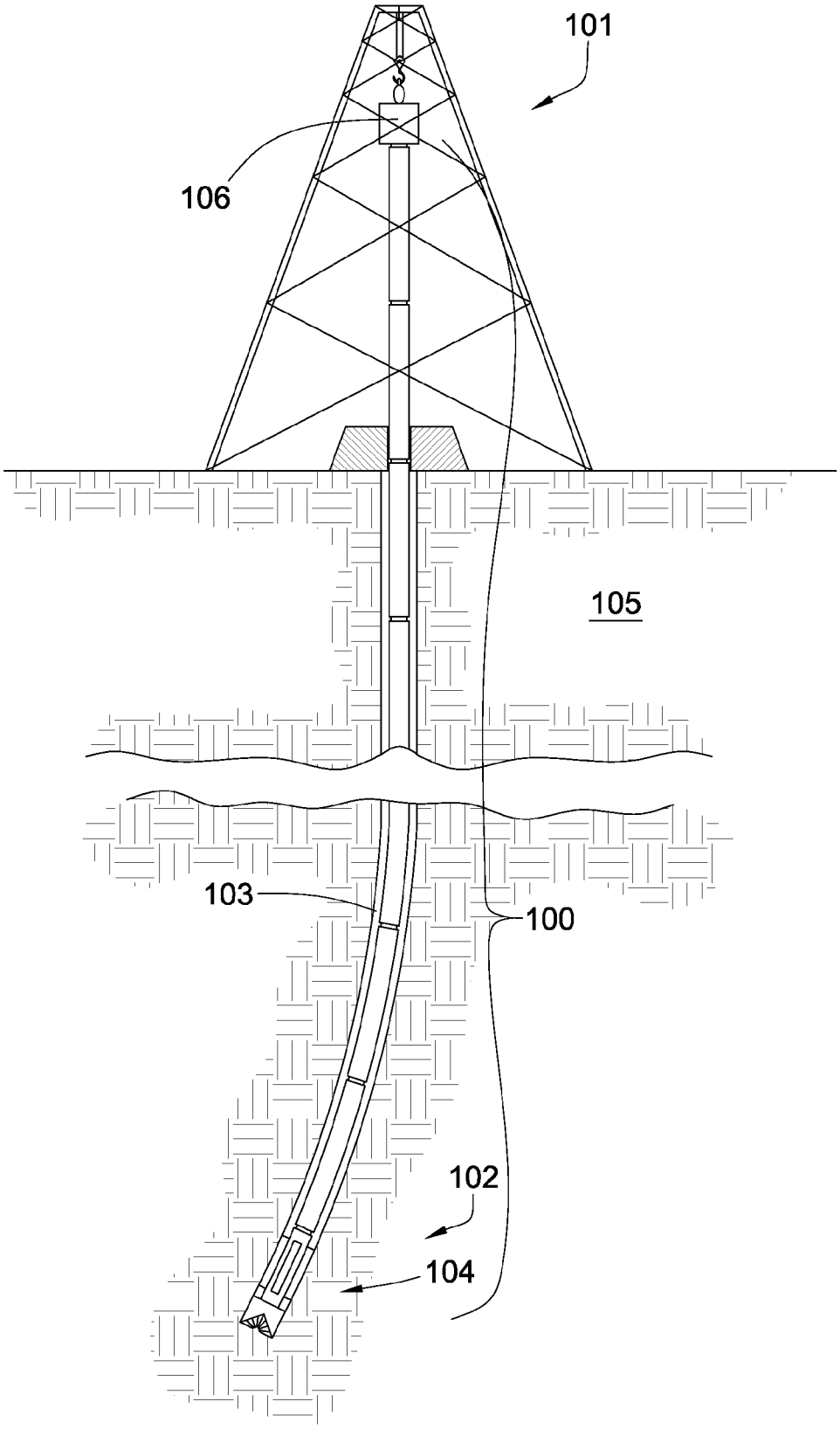
FIG. 1 is a perspective diagram of an embodiment of drill string suspended in a wellbore.

FIG. 1 is a perspective diagram of an embodiment of a drill string 100 suspended by a derrick 101. A bottom-hole assembly 102 is located at the bottom of a wellbore 103 and comprises a drill bit 104. As the drill bit 104 rotates downhole the drill string 100 advances farther into the earth. The drill string 100 may penetrate soft or hard subterranean formations 105. The drill bit 104 may be adapted to steer the drill string 100 in a desired trajectory. The bottom-hole assembly 102 and/or downhole components may comprise data acquisition devices which may gather data. The data may be sent to the surface via a transmission system to a data swivel 106. The data swivel 106 may send the data to the surface equipment. Further, the surface equipment may send data and/or power to downhole tools and/or the bottom-hole assembly 102. U.S. Pat. No. 6,670,880 which is herein incorporated by reference for all that it contains, discloses a telemetry system that may be compatible with the present invention; however, other forms of telemetry may also be compatible such as systems that include mud pulse systems, electromagnetic waves, radio waves, and/or short hop. In some embodiments, no telemetry system is incorporated into the drill string.

Figure 2:
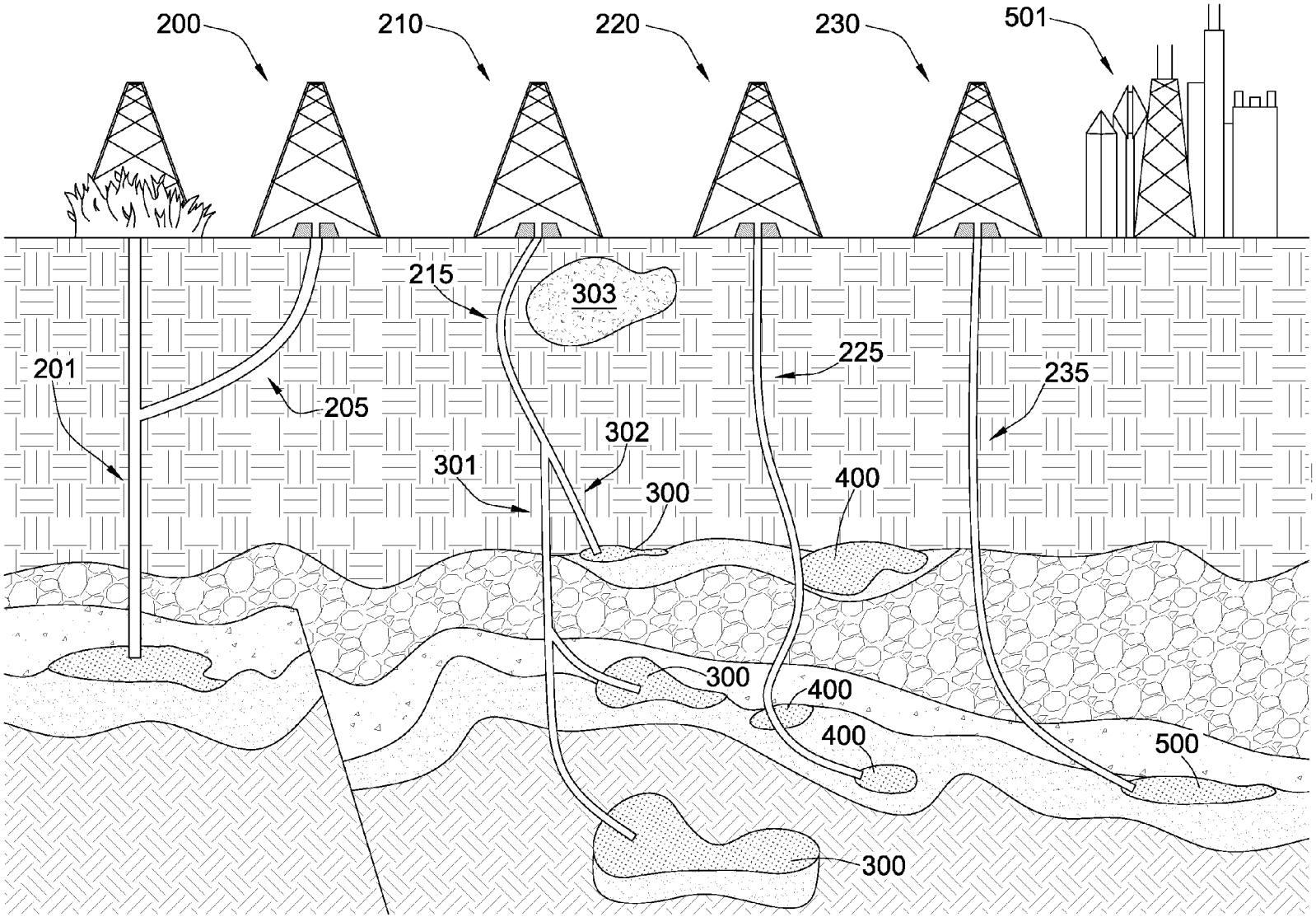
FIG. 2 is a perspective diagram of various embodiments of a drilling rig.

FIG. 2 illustrates embodiments of drilling rigs used in various steering applications. In one embodiment, a drilling rig 200 may be positioned so that a directional relief wellbore 205 may be drilled to intersect another well 201 in case of an emergency, such as a blowout, in order to reduce subsurface pressure in a controlled manner. A drilling rig 210 may be used in a drilling application in which multiple reservoirs 300, such as oil or gas reservoirs, are located approximately along a vertical trajectory. In such circumstances, it may be beneficial to drill in a substantially straight trajectory 301 adjacent the reservoirs 300 and from the substantially straight trajectory 301, drill multiple trajectories 302 branching off the main trajectory 301 toward the reservoirs 300. Also, it may be necessary during a drilling operation for a wellbore 215 to be formed around obstacles 303 such as boulders, hard formations, salt formations, or low pressure regions. Multiple reservoirs 400 may be reached with one drilling rig 220 when using a steerable drill string. A wellbore 225 may be drilled toward a first reservoir. If other wellbores are located near the first wellbore, the steering capabilities of the drill string may allow each reservoir to be drilled without removing the drill string and repositioning the drilling rig 225 for each drilling operation In some situations, a reservoir 500 may be located beneath a structure 501 such that a drilling rig 230 cannot be positioned directly above the reservoir and drill a straight trajectory. Thus, a wellbore 235 may need to be formed adjacent the structure 501 and follow a curved trajectory toward the reservoir using the steering capabilities of the drill string. Such tool string may be equipped to drill in off-shore applications as well as onshore applications.

Figure 3:
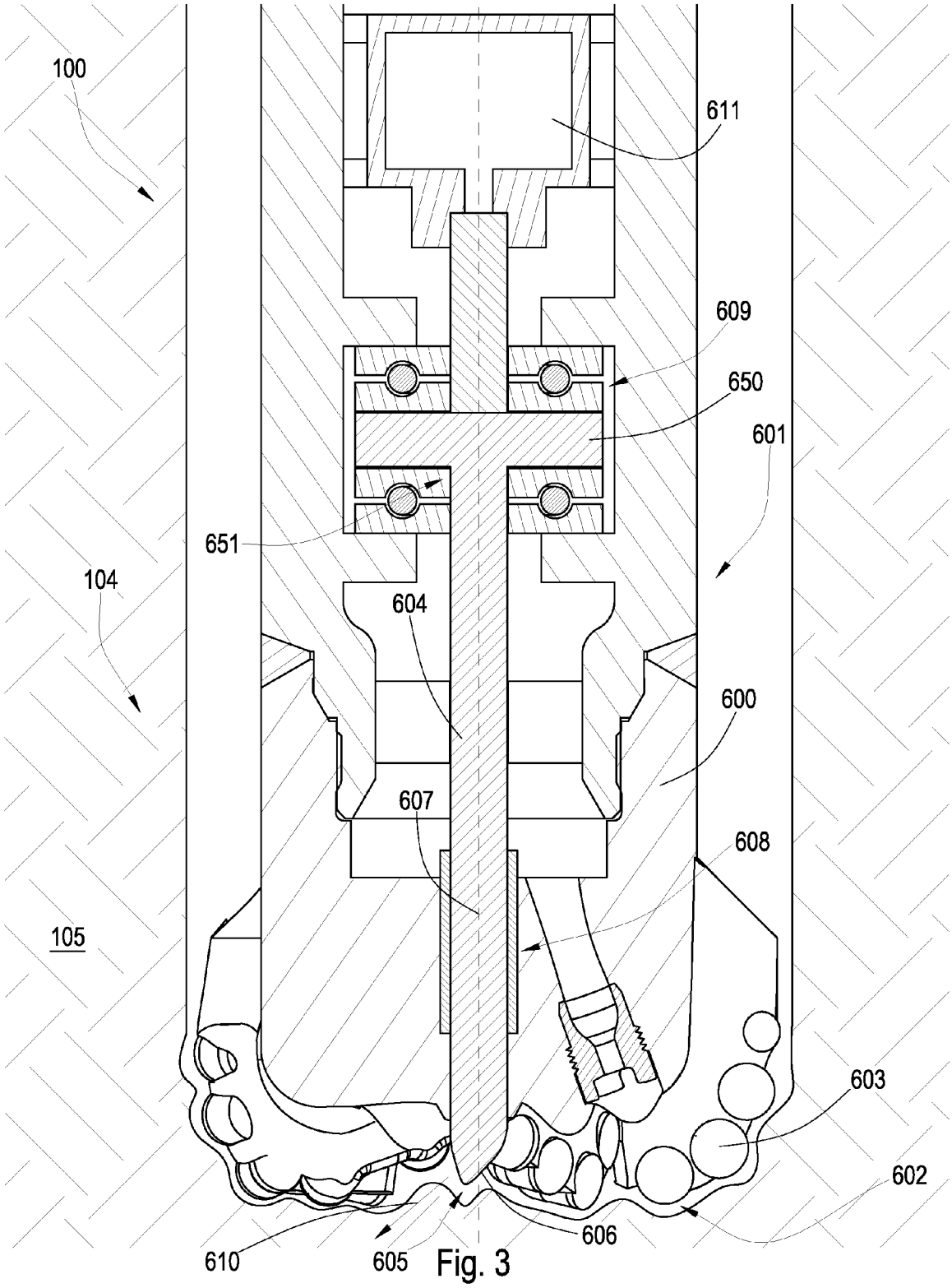
FIG. 3 is a cross-sectional diagram of an embodiment of a drill bit.

Now referring to FIG. 3, a drill bit 104 may have a body 600 intermediate a shank 601 and a working face 602. The working face 602 may have at least one cutting element 603. In the preferred embodiment, a jack element 604 may be disposed within the drill bit body 600 and may have a distal end 605 substantially protruding from the working face 602. The distal end 605 may have a primary deflecting surface 606 having an angle relative to a perpendicular to a central axis 607 of the jack element 604 of 15 to 75 degrees. The jack element 604 may be supported by a bushing 609 and/or bearing and may be in communication with at least one bearing 608. The bearings 608 may be disposed around a flange 650 near a proximal end 651 of the jack element 604 such that a load applied to the jack element 604 may be substantially carried by the bearings 608. The bushing 609 may be placed between the jack element 604 and the drill string 100 in order to allow for low-friction rotation of the jack element 604 with respect to the drill string 100. The bushing 609 may be beneficial in allowing the jack element 604 to be rotationally isolated from the drill string 100. Thus, during a drilling operation, the jack element 604 may steer the drill string 100 as the drill string 100 rotates around the jack element 604. The biased distal end 605 of the jack element 604 may cause the drill bit 104 to drill substantially in a direction indicated by an arrow 610, of the bias. In some drilling applications, the drill bit, when desired, may drill 6 to 20 degrees per 100 feet drilled. In some embodiments, the jack could be used to steer the tool string is a straight trajectory if the formation is such that it is trying to steer the tool string in an opposing direction. In some embodiments, the jack element 604 may be adapted for attachment to an electric motor 611. The jack element 604 and the drill string 100 may rotate opposite each other, the motor 611 controlling the rotation of the jack element 604. The jack element 604 and the drill string 100 may have equal and opposite rotational velocities so that the jack element 604 may be rotationally stationary with respect to the formation 105, thus steering the drill string 100.

Figure 4:
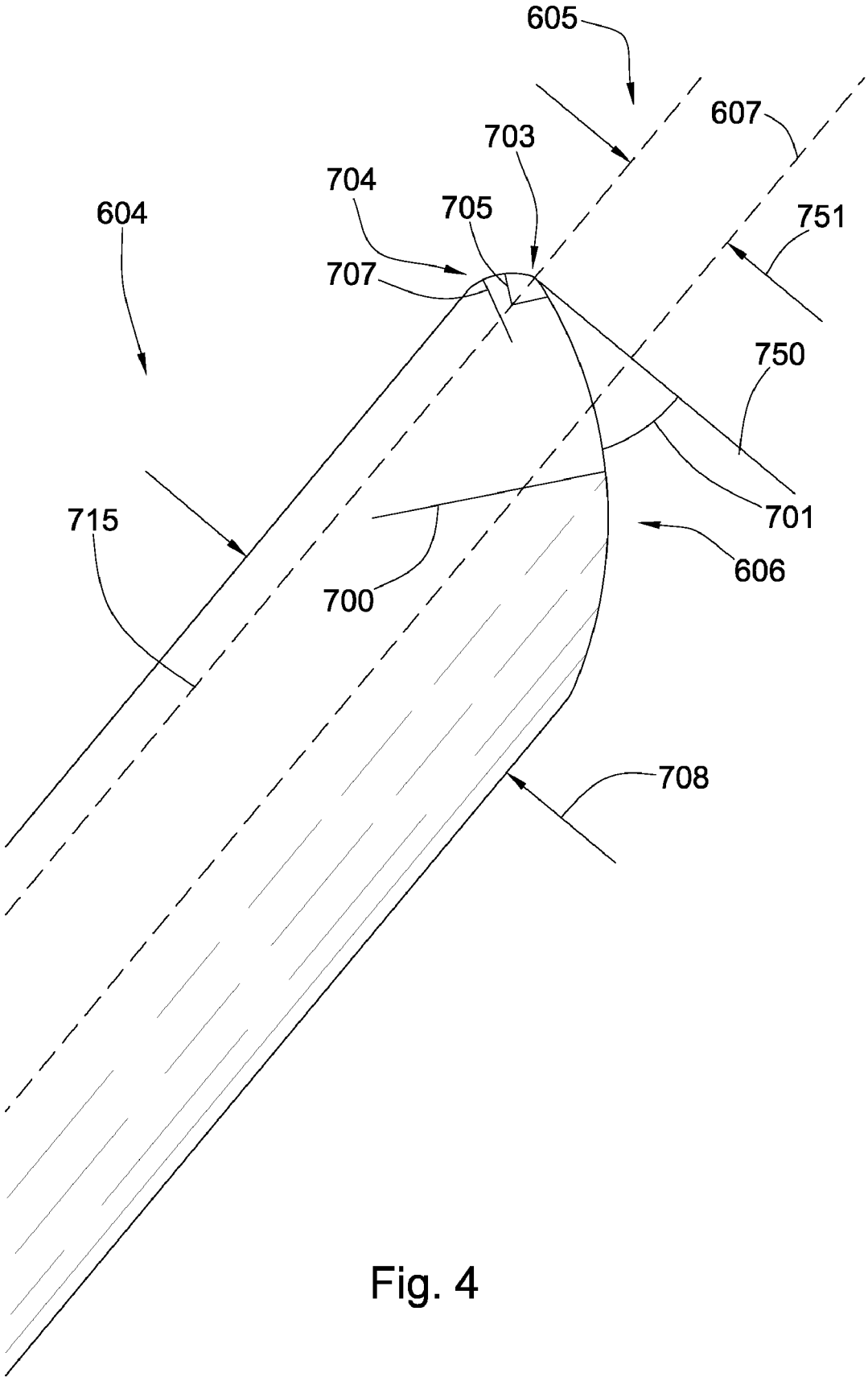
FIG. 4 is a perspective diagram of an embodiment of a jack element.

FIG. 4 is a perspective diagram of a jack element 604 with a distal end 605 having a primary deflecting surface 606; the primary surface 606 having an angle 701 relative to a perpendicular 750 to a central axis 607 of the jack element 604 of 15 to 75 degrees. In the preferred embodiment, the primary surface 606 may have an angle 701 of 40 to 50 degrees and a surface area of 0.5 to 4 square inches. An axis 715, through a tip 703 of the distal end 605, to the central axis 607 of the jack element 604 may comprise a distance 751 of 0.10 to 0.20 inch. The tip may also be rounded. The tip may comprise a 0.250 to 0.650 inch radius. The primary deflecting surface 606 and a secondary deflecting surface 704 of the distal end 605 may form a right angle 705. The primary surface 606 may have a radius of curvature 706 of 0.75 to 1.25 inches, whereas the secondary surface 704 may have a radius of curvature 707 of 0.25 to 0.75 inch. The jack element 604 may have a diameter 708 of 5 to 1 inch. The jack element 604 may comprise carbide. The distal end 605 of the jack element 604 may have rounded edges so that stresses exerted on the distal end 605 may be efficiently distributed rather than being concentrated on corners and edges. In some embodiments, the proximal end 651 (shown in FIG. 3) of the jack element 604 may have a diameter larger than the diameter 708 of the jack element 604 proximal the distal end 605.

Figure 5:
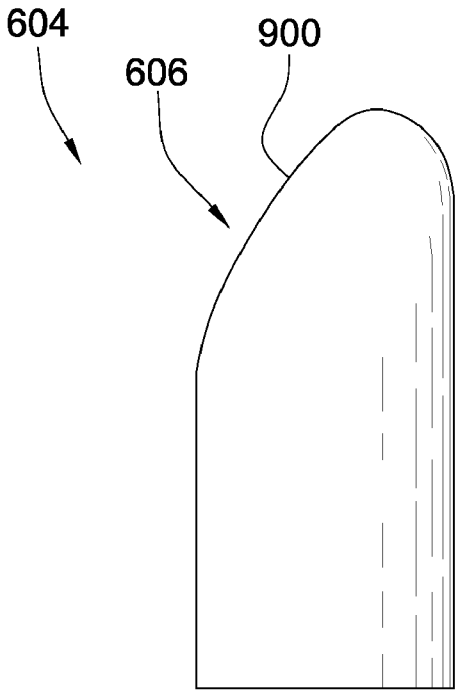
FIG. 5 is a perspective diagram of another embodiment of a jack element.
Figure 6:
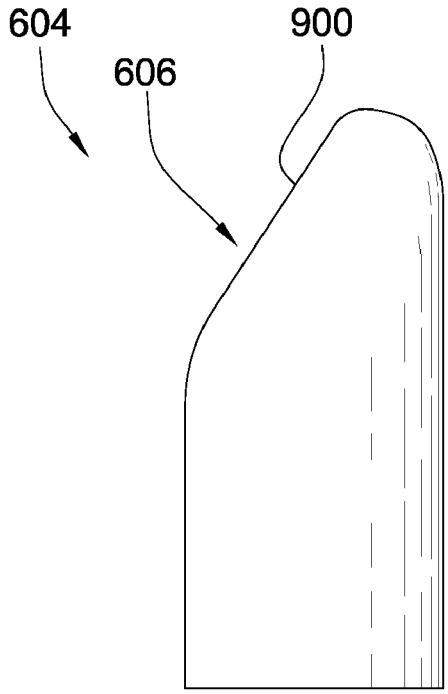
FIG. 6 is a perspective diagram of another embodiment of a jack element.
Figure 7:
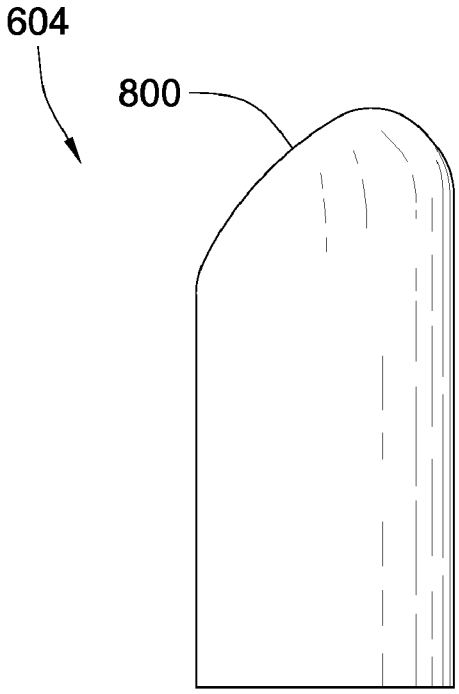
FIG. 7 is a perspective diagram of another embodiment of a jack element.
Figure 8:
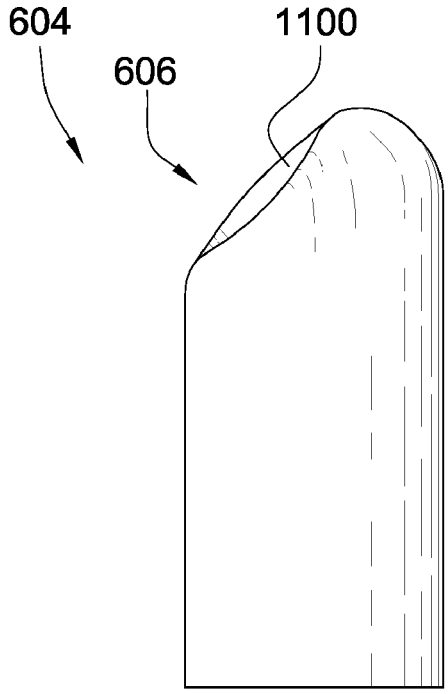
FIG. 8 is a perspective diagram of another embodiment of a jack element.

FIGS. 5 through 8 illustrate embodiments of various jack elements 604. FIG. 5 shows a primary deflecting surface 606 having a slightly convex geometry 900. In the embodiment of FIG. 6, the primary surface 606 may comprise a flat geometry 900. In FIG. 7, the jack element 604 may also have a slightly convex geometry 800, but may comprise a greater radius of curvature than the embodiment shown in FIG. 5. The primary deflecting surface may comprise a 0.750 to 1.250 inch radius. It is believed that a convex geometry will allow the jack element to crush the formation though point loading, verses through surface loading which may occur in embodiments with flats. It is believed that point loaded is preferred for steering applications. FIG. 8 shows a primary surface 606 having a slightly concave geometry 1100. The element may have a polygonal shape along it length.

Figure 10:
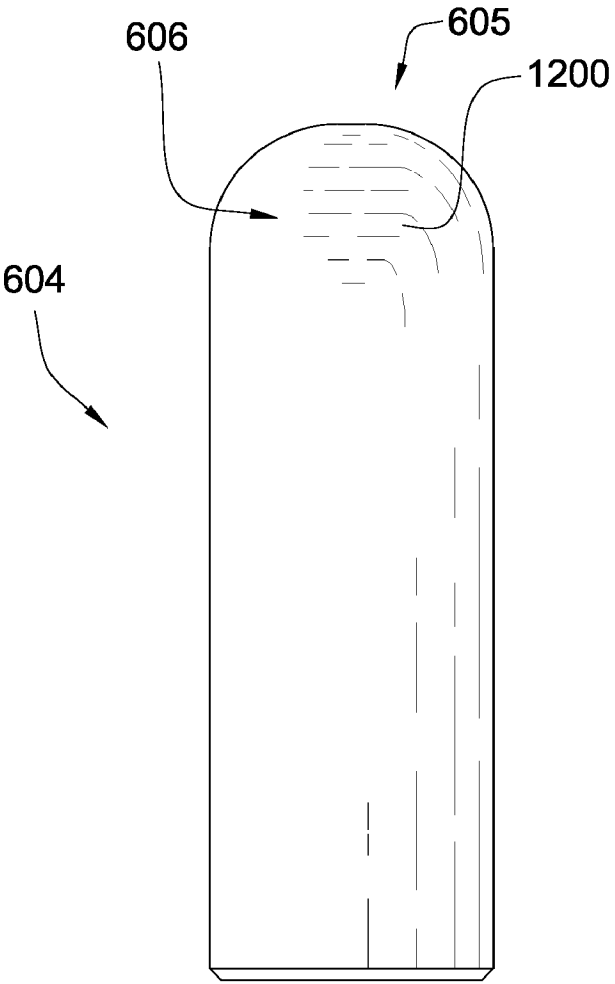
FIG. 10 is an orthogonal diagram of another embodiment of a jack element.
Figure 9:
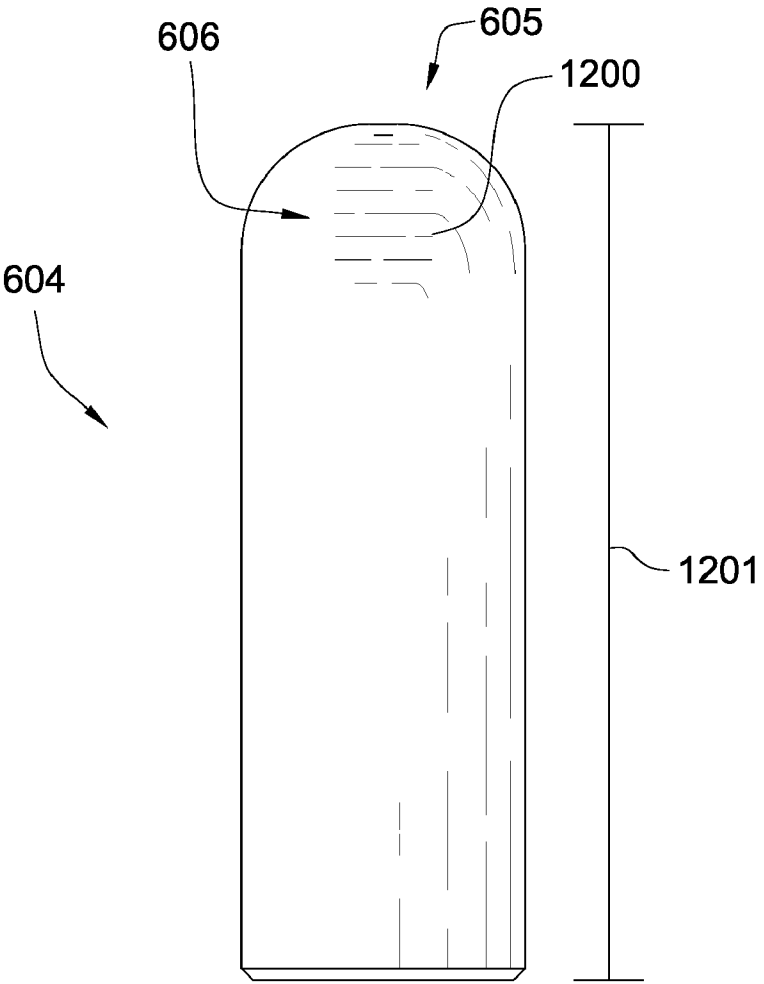
FIG. 9 is an orthogonal diagram of an embodiment of a jack element.

FIGS. 9 and 10 show embodiments of various geometries of a flat primary deflecting surface 606 of the distal end 605 of a jack element 604. In the embodiment of FIG. 9, the flat primary surface 606 may have a rectangular geometry 1200, whereas in the embodiment of FIG. 10, the flat primary deflecting surface 606 may have an elliptical geometry 1300. Also, the jack element 604 may comprise a length 1201 of 6 to 20 inches. The primary surface 606 may have a surface area of 0.5 to 4 square inches. In other embodiments, the flat primary surface of the jack element may comprise a circular or triangular geometry.

Figure 11:
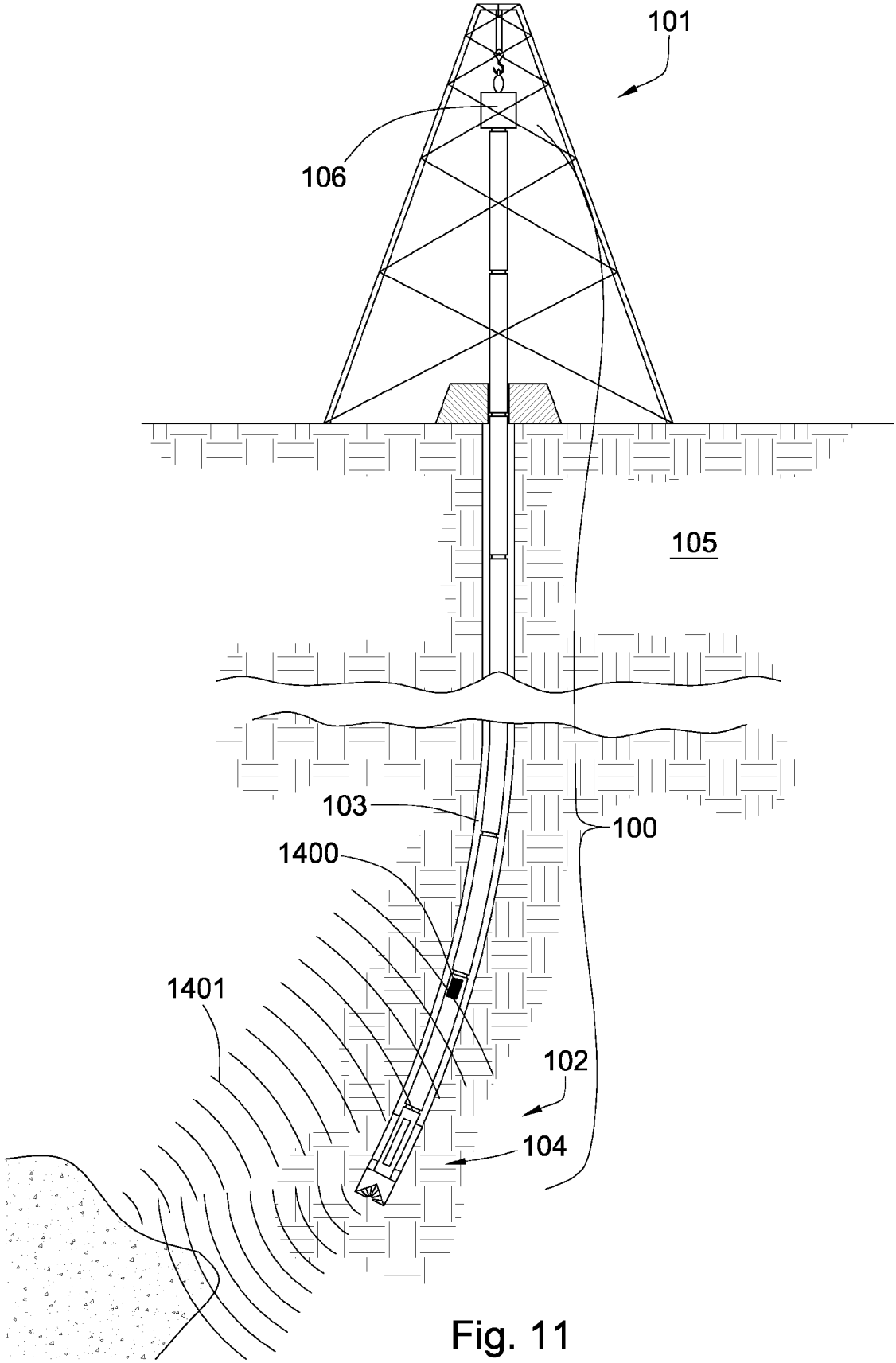
FIG. 11 is a perspective diagram of another embodiment of a drill string suspended in a wellbore.

Referring now to FIG. 11, a drill string 100 may be suspended by a derrick 101. A bottom hole assembly 102 is located at the bottom of a wellbore 103 and comprises a drill bit 104. As the drill bit 104 rotates downhole the drill string 100 advances farther into the earth. The drill string 100 may be steered in a preferred direction. In some embodiments, a sensor 1400 may be disposed on the surface of the drill string 100 and may be adapted to receive acoustic signals 1401 produced by the drill bit 104. The acoustic signals 1401 produced by the drill bit 104 may be returned from the formation 105. This may be useful in determining different formation characteristics.

Figure 12:
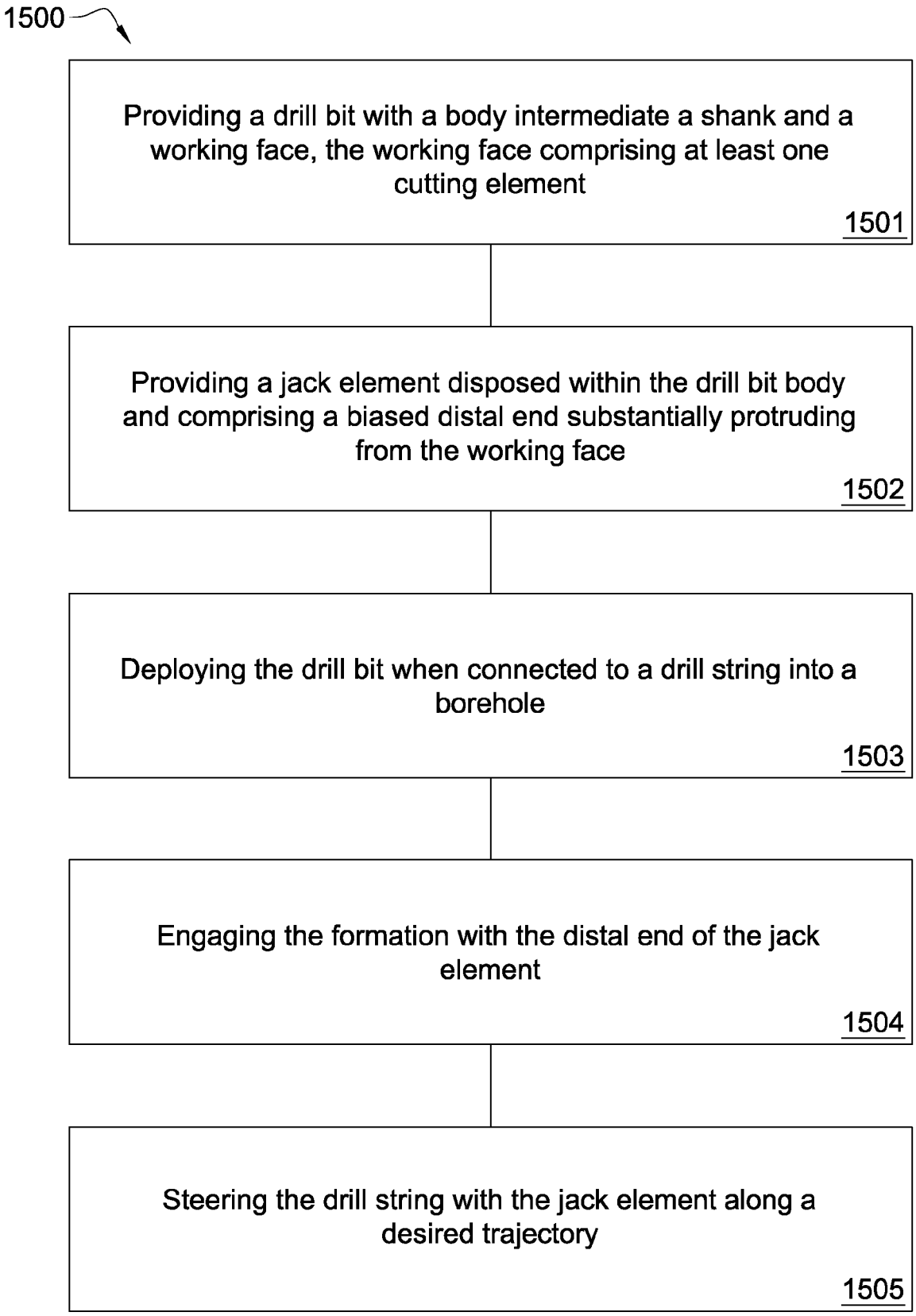
FIG. 12 is a diagram of an embodiment of a method for steering a drill string.

FIG. 12 is a diagram of an embodiment of a method 1500 for steering a drill string. The method 1500 includes providing 1501 a drill bit with a body intermediate a shank and a working face, the working face comprising at least one cutting. The method 1500 also includes providing 1502 a jack element disposed within the drill bit body and comprising a biased distal end substantially protruding from the working face. The method 1500 includes deploying 1503 the drill bit when connected to a drill string into a borehole. The method 1500 further includes engaging 1504 the formation with the distal end of the jack element and steering 1505 the drill string with the jack element along a desired trajectory.

Whereas the present invention has been described in particular relation to the drawings attached hereto, it should be understood that other and further modifications apart from those shown or suggested herein, may be made within the scope and spirit of the present invention.

What is claimed is:

1. A drill string comprising:

a drill bit with a body intermediate a shank and a working face, the working face comprising at least one cutting element;

a jack element disposed within the drill bit body and comprising a distal end substantially protruding from the working face;

and the distal end comprising a primary deflecting surface having an angle relative to a central axis of the jack element of 15 to 75 degrees;

wherein the jack element is rotationally isolated from the drill string.

2. The drill string of claim 1, wherein the primary deflecting surface comprises an angle relative to the central axis of 40 to 50 degrees.

3. The drill string of claim 1, wherein the primary deflecting surface comprises a surface area of 0.5 to 4 square inches.

4. The drill string of claim 1, wherein a tip of the distal end to the central axis of the jack element comprises a distance of 0.10 to 0.20 inch.

5. The drill string of claim 1, wherein the primary deflecting surface and a secondary deflecting surface of the distal end form a right angle.

6. The drill string of claim 5, wherein the secondary deflecting surface comprises a radius of curvature of 0.25 to 0.75 inch.

7. The drill string of claim 1, wherein the primary deflecting surface comprises a radius of curvature of 0.75 to 1.25 inches.

8. The drill string of claim 1, wherein the primary deflecting surface comprises a substantially flat portion.

9. The drill string of claim 1, wherein the primary deflecting surface comprises a substantially circular, rectangular, elliptical, or triangular geometry.

10. The drill string of claim 1, wherein the jack element comprises a length of 6 to 20 inches.

11. The drill string of claim 1, wherein the jack element is supported by a bushing.

12. The drill string of claim 1, wherein the jack element comprises carbide.

13. The drill string of claim 1, wherein the jack element is adapted for attachment to a motor.

14. The drill string of claim 1, wherein the distal end of the jack element comprises rounded edges.

15. The drill string of claim 1, wherein an end of the jack element opposite the distal end has a diameter larger than a diameter of the jack element proximal the distal end.

16. The drill string of claim 1, wherein a tip of the jack element comprises a 0.250 to 0.650 inch radius.

17. A method for steering a drill string, comprising the steps of:

providing a drill bit with a body intermediate a shank and a working face, the working face comprising at least one cutting element;

providing a rotationally isolated jack element disposed within the drill bit body and comprising a biased distal end substantially protruding from the working face;

deploying the drill bit when connected to a drill string into a borehole;

engaging the formation with the distal end of the jack element;

and steering the drill string with the jack element along a desired trajectory.

18. The method of claim 17, wherein the distal end comprises a primary deflecting surface.

19. The method of claim 17, wherein the drill bit comprises a build rate of 6 to 20 degrees per 100 feet drilled.

* * * * *